United States Patent [19]

Skalski

[11] Patent Number: 5,027,957

[45] Date of Patent: Jul. 2, 1991

[54] DISPLAY DEVICE

[75] Inventor: John Skalski, Hanover Park, Ill.

[73] Assignee: Thomas A. Schultz Company, Inc., Morton Grove, Ill.

[21] Appl. No.: 436,311

[22] Filed: Nov. 14, 1989

[51] Int. Cl.[5] ..... A47F 7/00

[52] U.S. Cl. ..... 211/59.3; 211/43; 211/51

[58] Field of Search ..... 211/59.3, 59.2, 43, 211/51, 184

[56] References Cited

U.S. PATENT DOCUMENTS

| | | | |
|---|---|---|---|
| 2,145,563 | 1/1939 | Watson | 211/59.3 X |
| 3,166,195 | 1/1965 | Taber | 211/59.3 X |
| 3,308,961 | 3/1967 | Chesley | 211/59.3 |
| 4,729,481 | 3/1988 | Hawkinson et al. | 211/59.3 |
| 4,830,201 | 5/1989 | Breslow | 211/59.3 X |

*Primary Examiner*—Carl D. Friedman
*Assistant Examiner*—Sarah Lechok
*Attorney, Agent, or Firm*—Wood, Phillips, Mason, Recktenwald & Vansanten

[57] ABSTRACT

A display device having a front cartridge section against which objects can be stacked, one against the other, in a first line; first and second strips each wound about itself to define first and second coils with first and second axes; structure for connecting the strips to the front cartridge section so that the axes of the coils are transverse to the first line; and a rear cartridge section having first and second legs which are extendable at least partially through the first and second coils. By moving the rear cartridge section away from the front cartridge section in the first line with the first and second legs extended into the first and second coils, the legs cause the first and second coils to unwind, whereby a force is developed on the first and second strips tending to draw the front and rear cartridge sections towards each other so that an article to be displayed can be resiliently captured in a display position between the front and rear cartridge sections.

18 Claims, 2 Drawing Sheets

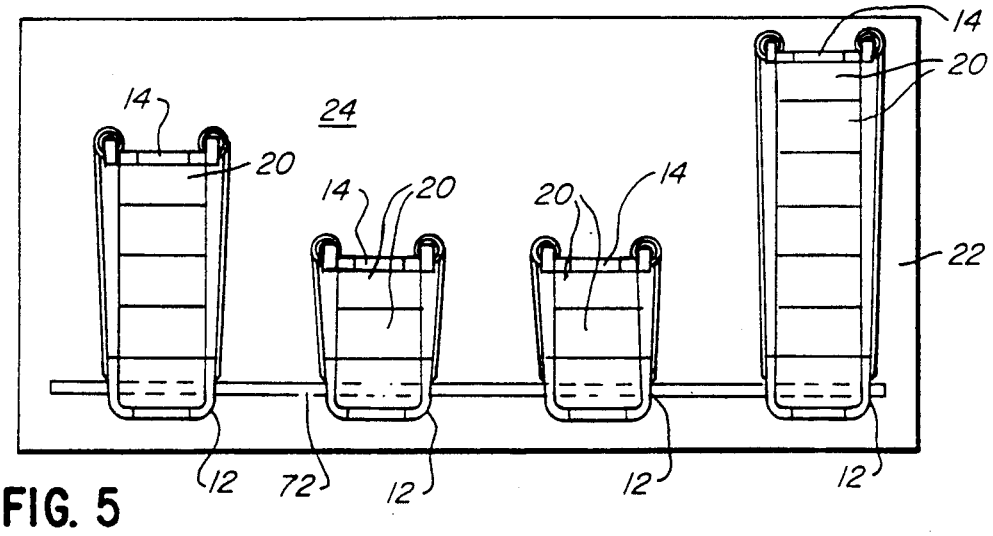
FIG. 5
FIG. 7
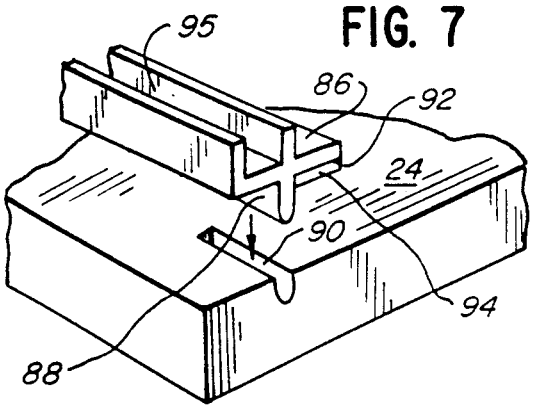
FIG. 6
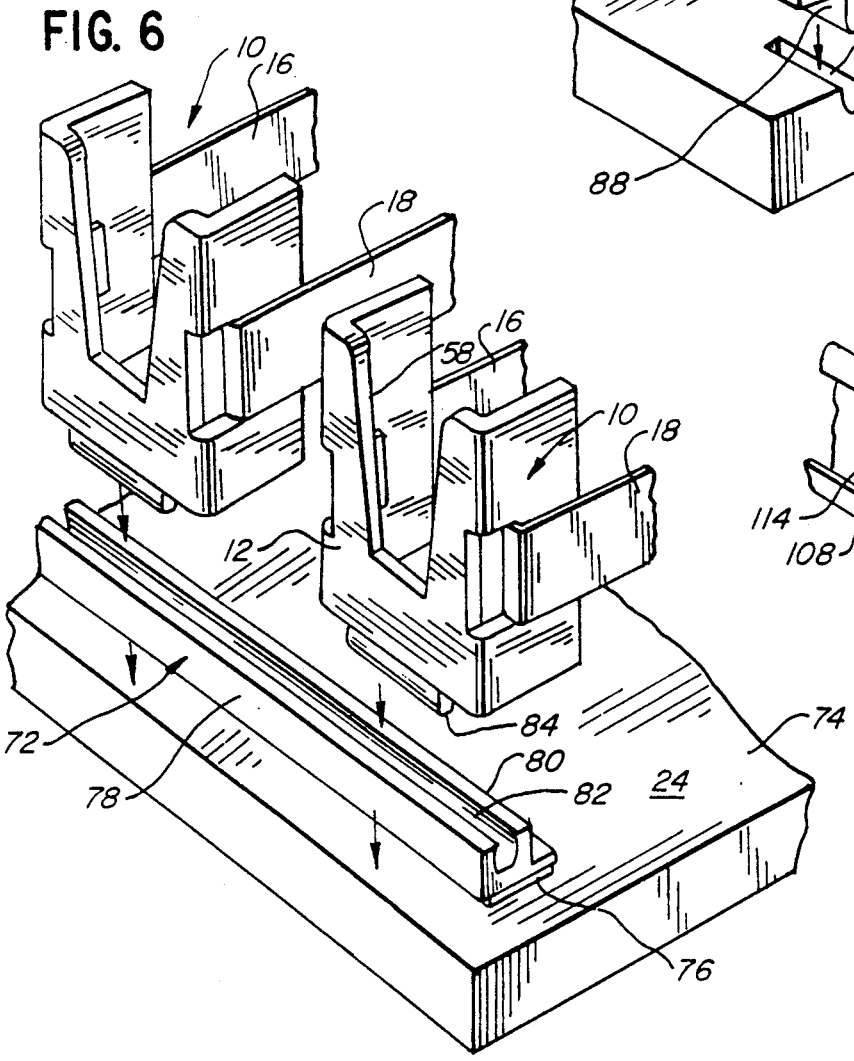
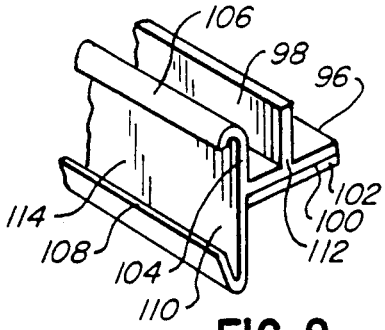
FIG. 8

DISPLAY DEVICE

BACKGROUND OF THE INVENTION

1. Field of the Invention

This invention relates to article display devices and, more particularly, to a device into which articles are loaded and normally urged into a display position.

2. Background Art

It is common to display merchandise in retail establishments in devices having elongate rails and pushers guided on the rails and biased so as to urge articles into a display position. One exemplary structure is shown in U.S. Pat. No 3,308,961, to Chesley. A pusher plate 28 is guided in fore and aft movement on spaced rails 32 fixedly secured to a support shelf. A coil spring 34 biases the pusher plate 28 towards the front of the device so that articles engaged thereby are biased into a display position.

While devices such as that shown in Chesley have proven effective for their intended purpose, they have numerous drawbacks. First, Chesley discloses an intricate arrangement of numerous elements Resultingly, the costs attendant the manufacture of such a device are relatively high.

Further, the Chesley components must be manufactured and assembled to close tolerances to be operable. A flaw in one of the rails 20, which are inherently prone to being bent in use, can render the entire device inoperable.

A further drawback with the Chesley device is that it must be custom built to match individual shelf configurations. It is therefore impossible to make a universal design for different retail establishments. On site assembly by skilled personnel may be required.

If one attempts to make a standard structure, the structure would be made to accommodate the largest anticipated number of articles. If only a few articles are in the display, a large unsightly structure remains in place, which makes the remainder of the shelf unuseable.

A still further drawback with a structure, such as that in Chesley, is that once in place, the device lacks versatility. That is, it is designed for a specific width article and a specific arrangement of articles along the width of the shelf. Should one desire to change shelf locations for specific articles, one would have to disassemble and reconstruct or replace the device on a different shelf. The inconvenience to a store operator is apparent.

The device such as that in Chesley is also inconvenient from a manufacturer's standpoint. Many different parts must be made and inventoried. The rails are long and thus take up a considerable amount of space. Because of the intricate interconnection of parts, variation in one dimension of the Chesley device, as required by one user, may require a redesign of the entire structure, which may not be feasible given the price ceilings contended with by manufacturers.

SUMMARY OF THE INVENTION

The present invention is specifically directed to overcoming the above-enumerated problems in a novel and simple manner.

According to the invention, a display device is provided and has a front cartridge section against which objects can be stacked, one against the other, in a first line; first and second strips each wound about itself to define first and second coils with first and second axes; structure for connecting the strips to the front cartridge section so that the axes of the coils are transverse to the first line; and a rear cartridge section having first and second legs which are extendable at least partially through the first and second coils. By moving the rear cartridge section away from the front cartridge section in the first line, with the first and second legs extended into the first and second coils, the legs cause the first and second coils to unwind, whereby a force is developed by the first and second strips tending to draw the front and rear cartridge sections towards each other so that an article to be displayed can be resiliently captured in a display position between the front and rear cartridge sections.

The present invention has as its principal objectives the provision of a simple, inexpensive display device which is extremely versatile. At the same time, the device has a very compact configuration.

The device can be configured so that, with no articles being displayed, the rear cartridge section is drawn closely against the front cartridge section by the strips. The compact configuration facilitates shipping and handling and minimizes inventory space requirements.

At the same time, the device is extremely simple by reason of its obviating the need for conventional guide structure, such as rails. The front cartridge section can be suitably secured to a shelf, at any desired location. The amount of space taken up by the overall device is dictated by the size and number of articles. With no articles in place, the rear cartridge section and strips retract into a very compact configuration. As the articles are loaded in place, one against the other, in a fore and aft direction, the biasing strips cause an even pressure to be applied by the back wall against the articles so that they are firmly captured in aligned relationship between the front and rear cartridge sections.

By simply varying the strip length, the capacity of the display device can be altered, as desired.

The invention also contemplates structure for attaching the front cartridge section both fixedly to a shelf and releasably to be selectively attached at any of a number of desired locations on the shelf.

The front cartridge section can be directly fixedly attached to a shelf through the use of screws, adhesives, etc. Alternatively, and in a preferred form, a rail is provided and suitably secured to the shelf on which articles are to be displayed. In one form, an elongate rail is provided with a lengthwise slot. The front cartridge section has a rib/projection which is received in the slot so that the projection is slidable lengthwise of the rail. The projection maintains the front cartridge section against fore and aft movement. With suitable rails on different shelves, the store owner can simply place the display device in a desired location on any shelf.

It is also possible to have a projection/slot integrally formed with the shelf and a cooperating rail/slot on the display device. By separating the device(s) from the rails, the shelf is freed to be useable for other purposes.

In one form of the invention, a clip is formed integrally with the rail, which clip is capable of carrying a price and/or descriptive information relating to the article.

To simplify manufacture of the device, preferably the rail is formed by an extrusion process. The front and rear cartridge sections are molded from plastic. The strips can be metal, MYLAR®, such as the coils described in U.S. Pat. No. 3,426,115, or other suitable material capable of maintaining a coiled configuration. Assembly of the device involves merely securing the strip ends to the front cartridge section and projecting the legs on the rear cartridge section through the coils.

In its simplest form, the rear cartridge wall can be a U-shaped member, such as a formed wire. The U-shaped wire is directed through the coils, preferably in an inverted orientation.

Another aspect of the invention is the provision of structure on the rear cartridge wall extending upwardly beyond the anticipated height of objects to be displayed so that the location of the rearwardmost article displayed by the device can be readily identified, thereby facilitating inventorying by the store owner.

BRIEF DESCRIPTION OF THE DRAWINGS

FIG. 5 is a schematic plan view of a plurality of the inventive display devices on a shelf;

FIG. 6 is a perspective view of a shelf section showing a mounting element/rail thereon for a plurality of display devices;

FIG. 7 is a perspective view of a section of a shelf with a groove therein for reception of a mounting element for the display device; and FIG. 8 is a perspective view of a section of a modified form of mounting element/rail.

DETAILED DESCRIPTION OF THE DRAWINGS

Figure 1:
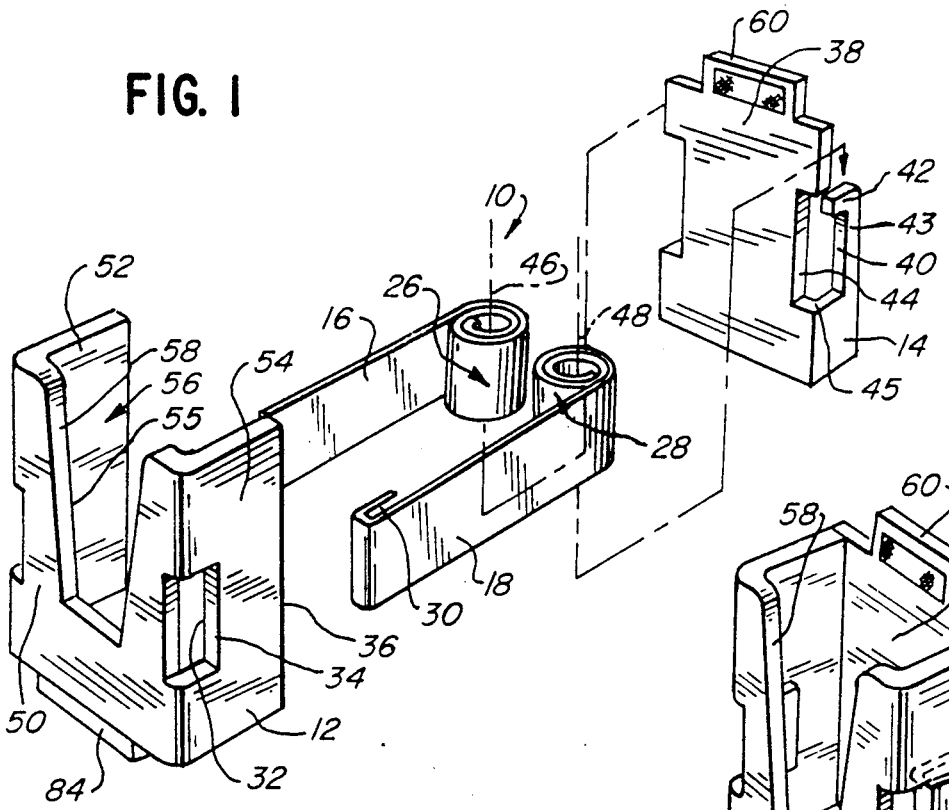
FIG. 1 is an exploded perspective view of a display device, according to the present invention.
Figure 2:
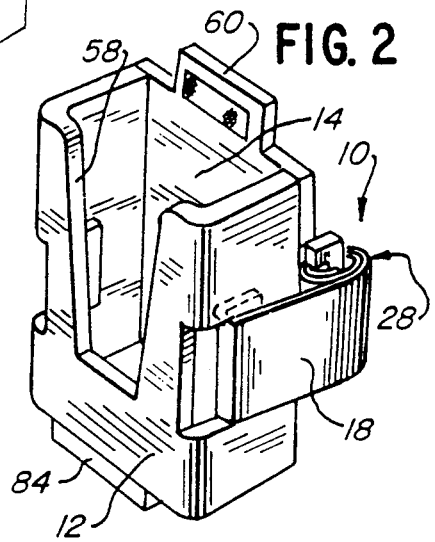
FIG. 2 is a perspective view of the device in FIG. 1 in its assembled state without any articles displayed therein.

One form of display device, according to the present invention, is shown at 10 in FIGS. 1 and 2. The display device/cartridge 10 consists of a front cartridge section 12, a rear cartridge section 14, and first and second flexible strips 16, 18, respectively, for interconnecting the front and rear cartridge sections 12, 14.

The above elements cooperate to releasably embrace a plurality of articles 20 to be displayed, as depicted schematically in FIG. 5. The articles 20 may take any shape and size. The articles 20 are shown in squared containers, such as cigarette packs and the like. It should be understood that the identity of the article 20 is irrelevant to the invention.

The invention contemplates that the front cartridge section 12 be attached to the upwardly facing surface 22 of a shelf 24. The articles 20 are loaded between the front cartridge section 12 and rear cartridge section 14 and are biased towards the front cartridge section 12 by the strips 16, 18 into a display position, wherein they are readily seen and removable by a consumer.

To accomplish the above, the strips 16, 18 are wrapped about themselves to define coils 26, 28, respectively. The strips 16, 18 may be formed of conventional spring-type metal, or by other material, such as MYLAR®. In U.S. Pat. No 3,426,115, a suitable method is disclosed for forming MYLAR® coils, that can be used according to the present invention. The strips can have a width as shown in FIGS. 1–4, or may be wider such as the corresponding strips 16, 18 shown in FIG. 6.

Connection of each strip 16, 18 to the cartridge sections 12, 14 is the same, and thus description herein will be limited to exemplary strip 18. The strip 18 has a forward end 30, which is connected to the front cartridge section 12. A cutout 32 is provided in the front cartridge section to define a forwardly facing edge 34. The free end 30 of the strip 18 is wrapped around the edge 34 and suitable secured to the front cartridge section 12 thereadjacent, as by an adhesive. With the strip end 30 connected to the section 12, as shown, the coil 28 resides closely adjacent to the rear edge 36, as seen in FIG. 2.

The rear cartridge section 14 has a forwardly facing surface 38 for abutment with the edge 36 of the wall 12. The wall 14 has upwardly projecting legs 40 (one shown) spaced slightly rearwardly of the wall surface 38. With the strips 16, 18 secured to the front cartridge section 12, the rear cartridge section 14 can be assembled by directing the leg 40 upwardly through the coil 28. The leg 40 has sufficient height that it projects fully through the coil 28. A transverse blocking member 42 is provided on the free end 43 of the leg 40 to prevent escape of the coil 28 from the leg 40 in use. The rear cartridge section 14 has a cutout 44 to accommodate the coil 28 with the coil 28 surrounding the leg 40. The cutout defines a ledge 45 for supporting the coil 28. The opposite leg (not shown) on the rear cartridge section 14 extends through the coil 26 in like manner. Preferably, the legs 40 on the rear cartridge section 14 are substantially parallel, as are the axes 46, 48 of the coils 26, 28, respectively, through which the legs 40 extend.

With the device 10 assembled, the strips 16, 18 tend towards their wrapped configuration and in so doing draw the rear cartridge section 14 against the front cartridge section 12, as shown in FIG. 2. As articles are loaded between the cartridge sections 12, 14, the strips 16, 18 are caused to unwind, while maintaining a bias tending to draw the cartridge sections 12, 14 towards each other. The force developed by the strips 16, 18 is the same so that the articles 20 remain positively in line, one behind the other, as seen in FIG. 5. As is apparent from Figs. 1, 2 and 5, the device 10 is very compact and takes up an amount of space directly proportional to the number of articles 20 loaded therein.

Preferably, the cartridge sections 12, 14 are molded from plastic. The front cartridge section 12 has a front wall 50 and spaced side walls 52, 54 projecting rearwardly from the front wall 50. The rearwardly facing surface 55 of the front wall 50 and the side walls 52, 54 cooperatively define a receptacle at 56 configured to match the shape of and be slightly larger than one of the articles 20 to be displayed by the device 10. The rear cartridge section 14, under the force exerted by the strips 14, 18, urges an article 20 into the receptacle 56 and a display position for that article 20. A cutout 58 is provided in the front wall 50 to permit viewing of the article 20 in the display position and grasping by a purchaser for removal.

The rear cartridge section 14 has a tab 60 projecting upwardly beyond the maximum anticipated height of the articles 20, so as to give a visual indication of the rearwardmost article 20. This conveniently and positively alerts the store owner as to the number of articles 20 in the device 10.

Figure 3:
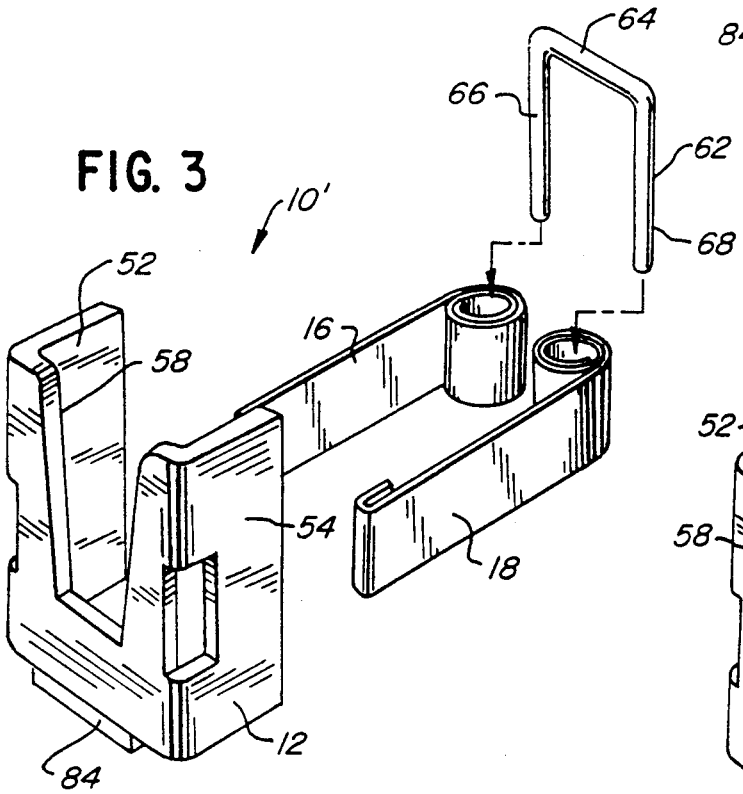
FIG. 3 is a perspective view of a modified form of display device, according to the present invention.
Figure 4:
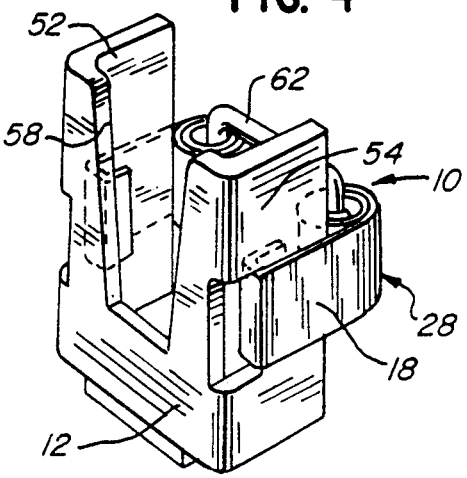
FIG. 4 is a perspective view of the device in FIG. 3 in its assembled state without any articles displayed therein.

A simplified form of the device 10 is shown at 10' in FIGS. 3 and 4. The only difference between the device 10' in FIGS. 3 and 4 and that 10 in FIGS. 1 and 2 is that the rear cartridge section 62 in the former is modified from that 14 in FIGS. 1 and 2. The cartridge section 62 is a simple U-shaped element with a cross bar 64 and depending legs 66, 68. The legs 66, 68 are directed downwardly through the coils 26, 28, respectively, and are drawn by the coils as the strips 16, 18 tend to rewind themselves. The rear cartridge section 62 can be simply formed by a piece of heavy gauge wire or alternatively formed as a molded piece of plastic.

The invention also contemplates structure for holding the device 10 fixedly against fore and aft movement on a shelf 24. The structure for doing this is shown in FIGS. 5–8. An elongate mounting element/rail 70, preferably formed by an extrusion process, is mounted to the upwardly facing surface 74 of the shelf 24. The rail 72 can be held in place by a two-sided adhesive strip 76, or by other suitable means, such as screws, etc. The rail has spaced walls 78, 80 defining therebetween an upwardly opening, U-shaped groove 82.

The front cartridge section 12 has a depending rib/-projection 84, which is accepted by the groove 82. The projection has a cross section generally matched to that of the groove 82 and is dimensioned to be snugly, but releasably accepted within the rail groove 82. To assemble the device 10 on the shelf 24, one need only press the rib/projection 84 into the groove 82 at the desired location along the shelf width. The articles 20 can then be simply loaded between the front and rear cartridge sections 12, 14, respectively. The device 10 needs no additional guide structure and takes up only that amount of space on the shelf 24 as is needed by the number of articles being displayed. If the display device 10 is no longer needed, it is simply drawn upwardly off of the rail 70 so that the shelf 24 is free to be used as desired.

Modified forms of the rail 12 are shown in FIGS. 7 and 8. In FIG. 7, a rail 86 is shown with a rib 88 projecting downwardly therefrom for reception in a groove 90, defined directly in the shelf 24. The rail 86 has a downwardly facing surface 92 for bearing against the upwardly facing surface 74 of the shelf 24. An adhesive layer 94 is interposed between the surfaces 92, 74 to prevent lateral shifting of the rail 86 relative to the shelf 24 and separation of the rib 88 from the groove 90. The rail 86 has a corresponding, upwardly opening groove 94 for acceptance of the ribs 84 on the devices 10. It should be understood that the rib 84 can be configured to cooperate directly with the groove 90 in the shelf 24. This obviates the need for a separate rail 86.

A further modified form of rail 96 is shown in FIG. 8. The rail 96 has an upwardly opening groove 98 for the ribs 84 and a downwardly facing surface 100 attached to the upwardly facing shelf surface 74, as by an adhesive strip 102. The principal difference between the rail 96 and that 86 in FIG. 7 is that the forward wall 104 bounding the groove 98 has a downwardly turned upper end 106 and an upwardly turned bottom end 108, defined on the portion 110 of the wall 104 extending downwardly below the main body 112 of the rail 96. The forwardly facing surface 114 of the wall 104 can accommodate pricing information, etc. relating to the articles 20 in the device 10. The turned ends 106, 108 cooperate to capture paper strips, or the like, placed against the surface 114.

The foregoing disclosure of specific embodiments is intended to be illustrative of the broad concepts comprehended by the invention.

I claim:

1. A display device comprising:

a front cartridge section against which objects are to be stacked, one against the other, in a first line; said front cartridge section further having a front wall with a rearwardly facing surface and spaced side walls which define in conjunction with the front wall surface a receptacle for said objects to be displayed a first strip wound about itself to define a first coil with a first axis;

a second strip wound about itself to define a second coil with a second axis;

means for connecting the strips to the front cartridge section so that the first and second axes are each substantially perpendicular to the first line; and a rear cartridge section having first and second legs which are extendable at least partially through the first and second coils, whereby by moving the rear cartridge section away from the cartridge section in said first line, with the first and second legs extended into the first and second coils, the legs cause the first and second coils to unwind so that a force is developed by said first and second strips tending to draw the rear cartridge section toward the front cartridge section so that said objects to be displayed can be resiliently captured in a display position between the front and rear cartridge sections, said first and second strips being the sole means for providing a force urging the rear cartridge section toward the front cartridge section.

2. The display device according to claim 1 wherein at least one of the first and second strips is made at least partially from plastic.

3. The display device according to claim 1 wherein at least one of the first and second strips is made at least partially from metal.

4. The display device according to claim 1 wherein said front cartridge section includes means for attaching the front cartridge section to a shelf on which articles are to be displayed.

5. The display device according to claim 1 wherein said front cartridge section includes means for releasably attaching the front cartridge section to a shelf on which articles are to be displayed.

6. The display device according to claim 1 in combination with a mounting element, said mounting element including means for attaching the mounting element to a shelf on which articles are to be displayed, and said front cartridge section includes means for attaching the front cartridge section to the mounting element to prevent movement of the front cartridge section in said first line.

7. The display device according to claim 1 in combination with a shelf having means for mounting the front cartridge section to the shelf, said front cartridge section including means for attaching the front cartridge section to said shelf mounting means.

8. The display device according to claim 1 wherein said rear cartridge section has means thereon extending upwardly beyond the anticipated height of objects to be displayed by said device for giving a visual indication of the location of a rearwardmost article displayed by said device.

9. The display device according to claim 1 wherein said coil axes are parallel to each other and in a substantially vertical orientation.

10. The display device according to claim 1 wherein said rear cartridge section has a U-shaped configuration.

11. The display device according to claim 1 wherein at least one said leg has a free end with a blocking member adjacent to said free end to prevent escape of the coil from said one leg.

12. The display device according to claim 1 wherein the front wall has a cutout to permit viewing of a forwardmost article being displayed.

13. The display device according to claim 6 wherein the mounting element comprises an elongate rail and the attaching means for the front cartridge section includes means for attaching the front cartridge section selectively at different positions along the length of the rail.

14. A display device comprising:

a front cartridge section; said front cartridge section further having a front wall with a rearwardly facing surface and spaced sidewalls which define in conjunction with the front wall surface a receptacle for an article to be displayed a rear cartridge section;

an extendable strip; and means for connecting the strip to the front and rear cartridge sections so that the front cartridge section, rear cartridge section and strip cooperatively extend in a continuous loop around articles to be displayed and the strip urges the front and rear cartridge sections in a first line toward each other to releasably embrace articles to be displayed between said front and rear cartridge sections, said strip being wrapped about itself to define a coil with a vertical axis that is substantially perpendicular to the first line and as the front and rear cartridge sections are moved away from each other the coil unwraps to permit the front and rear cartridge sections to move away from each other, said front and rear cartridge sections being urged towards each other solely by a force produced by the strip tending to rewrap itself, said strip preventing shifting of displayed articles transverse to the first line.

15. The display device according to claim 14 including means for attaching the front cartridge section to a shelf on which articles are to be displayed.

16. The display device according to claim 14 including means for removably fixedly attaching the front cartridge section at selected positions on a shelf on which articles are to be displayed.

17. A display device comprising:

a front cartridge section against which objects are to be stacked, one against the other, in a first line; said front cartridge section further having a front wall with a rearwardly facing surface and spaced side walls which define in conjunction with the front wall surface a receptacle for said objects to be displayed a first strip wound about itself to define a first coil with a first axis;

a second strip wound about itself to define a second coil with a second axis;

means for connecting the strips to the front cartridge section so that the first and second axes are each substantially perpendicular to the first line; and a rear cartridge section having first and second legs which are extendable at least partially through the first and second coils, whereby by moving the rear cartridge section away from the front cartridge section in said first line, with the first and second legs extended into the first and second coils, the legs cause the first and second coils to unwind so that a force is developed by said first and second strips tending to draw the rear cartridge section toward the front cartridge section so that said objects to be displayed can be resiliently captured in a display position between the front and rear cartridge sections, said first and second strips being the primary means for providing a force urging the rear cartridge section toward the front cartridge section.

18. A display device comprising: a front cartridge section; said front cartridge section further having a front wall with a rearwardly facing surface and spaced sidewalls which define in conjunction with the front wall surface a receptacle for an article to be displayed a rear cartridge section;

an extendable strip; and means for connecting the strip to the front and rear cartridge sections so that the front cartridge section, rear cartridge section and strip cooperatively extend in a continuous loop around articles to be displayed and the strip urges the front and rear cartridge sections in a first line toward each other to releasably embrace articles to be displayed between said front and rear cartridge sections, said strip being wrapped about itself to define a coil with a vertical axis that is substantially perpendicular to the first line and as the front and rear cartridge sections are moved away from each other the coil unwraps to permit the front and rear cartridge sections to move away from each other, said front and rear cartridge sections being urged towards each other primarily by a force produced by the strip tending to rewrap itself, said strip preventing shifting of displayed articles transverse to the first line.

* * * * *